US005957666A

United States Patent [19]

Lee

[11] Patent Number: 5,957,666

[45] Date of Patent: Sep. 28, 1999

[54] TANDEM-TYPE PUMP HAVING AN AUXILIARY PUMP

[75] Inventor: Kyung Sub Lee, Kyungsangnam-do, Rep. of Korea

[73] Assignee: Volvo Construction Equipment Korea Co., Ltd., Rep. of Korea

[21] Appl. No.: 08/988,615

[22] Filed: Dec. 11, 1997

[30] Foreign Application Priority Data

Mar. 22, 1997 [KR] Rep. of Korea ..... 97-9950

[51] Int. Cl.[6] ..... F04B 1/12; F04B 7/04; F04F 11/00

[52] U.S. Cl. ..... 417/269; 417/70; 417/71; 417/501

[58] Field of Search ..... 417/269, 70, 71, 417/501

[56] References Cited

U.S. PATENT DOCUMENTS

| | | | |
|---|---|---|---|
| 4,534,271 | 8/1985 | Forster | 91/472 |
| 5,540,563 | 7/1996 | Hansell | 417/269 |
| 5,800,134 | 9/1998 | Hasegawa et al. | 417/269 |

*Primary Examiner*—Charles G. Freay
*Assistant Examiner*—Paul Ratcliffe
*Attorney, Agent, or Firm*—Harness, Dickey & Pierce, P.L.C.

[57] ABSTRACT

A tandem-type pump assembly having a first housing and a second housing. A first main pump and a second main pump are coaxially aligned and disposed in the first housing. A first driving shaft having a first end and a second end is rotatably supported in the first housing and coaxially interconnects the first main pump and the second main pump. A driving gear is fixed to the first end of the first driving shaft for rotation therewith. A second driving shaft is rotatably supported in the second housing for driving an auxiliary pump. A driven gear is fixed to the second driving shaft for rotation therewith and directly engages the driving gear.

4 Claims, 2 Drawing Sheets

TANDEM-TYPE PUMP HAVING AN AUXILIARY PUMP

BACKGROUND OF THE INVENTION

1. Field of the Invention

The present invention relates to a tandem-type pump having an auxiliary pump, and more particularly to a tandem-type pump having an auxiliary pump being provided with an auxiliary shaft which is installed in an extension housing disposed adjacent to and driven by a driving shaft of a tandem-type and wobble plate-type piston pump for construction equipment.

2. Description of the Prior Art

Generally, construction equipment is provided with a tandem-type and wobble plate-type piston pump. In the piston pump, two main pumps are connected with each other in a coaxial relationship and are driven by a single driving shaft. The driving shaft of the piston pump is connected with an auxiliary shaft. The auxiliary shaft is driven by the driving shaft. The auxiliary shaft operates an auxiliary pump being used as an auxiliary hydraulic power unit or as a pilot hydraulic power unit for the construction equipment by receiving a driving force from the driving shaft.

FIG. 1 is a schematic sectional view of an auxiliary pump according to the prior art.

FIG. 2 is a sectional view taken along a line A—A of FIG. 1.

Referring to FIGS. 1 and 2, a middle block 3 is disposed in the middle of a housing 1. A connector 6 is installed in the middle block 3. The connector 6 connects a left portion of a driving shaft 4 with a right portion of the driving shaft 4, which are coaxially aligned and are separated from each other by the middle block 3.

The left portion and the right portion of the driving shaft 4 are simultaneously driven by the connector 6. Thereby, wobble plate-type piston pumps, which are positioned at both sides of the driving shaft 4, begin to operate.

Meanwhile, teeth are formed at an outer periphery of the connector 6. The teeth of the connector 6 are engaged with a first idle gear 9. The first idle gear 9 is engaged with a second idle gear 10 in sequence. The second idle gear 10 is engaged with teeth formed at an outer periphery of an auxiliary shaft 8 for driving an auxiliary pump. Since a large number of gears are engaged with each other in sequence as described above, the auxiliary shaft 8 receives a driving force from the connector 6, which is located in the middle of the main pump, in order to connect the left portion with the right portion of the driving shaft 4. In other words, since an outer diameter of the teeth formed at the outer periphery of the connector 6 is limited by the available space of the middle block 3, the driving force provided by the connector 6 is transmitted to the auxiliary shaft 8 through a large number of gears.

In the tandem-type pump having the auxiliary pump as described above, it is necessary to have two to three idle gears and a plurality of supporting bearings 11 for supporting the idle gears. Accordingly, the number of components and the number of stages for transmitting the driving force are increased. As a result, heavy noise and severe vibration can be generated during engagement of the gears for transmitting the driving force, and thereby the loss of the driving force is highly increased.

Further, in the tandem-type pump according to the prior art, an additional auxiliary pump block 13 is mounted to the middle block 3 in order to transmit the torque of the driving shaft 4 to the auxiliary shaft 8. In the same manner as the middle block 3, the auxiliary pump block 13 is provided with a plurality of idle gears and a large number of bearings for supporting the idle gears. Accordingly, the total weight of the tandem-type pump is highly increased. As a result, the center of gravity of the tandem-type pump offset from a mounting flange (not shown). The mounting flange couples the main pump to the construction equipment. The center of gravity offset thereby produces a moment of inertia in the tandem-type pump. Consequently, the driving stability of the increased tandem-type pump deteriorates due to the vibration occurring during operation of the tandem-type pump.

SUMMARY OF THE INVENTION

The present invention is contrived to solve the foregoing problems. It is an object of the present invention to provide a tandem-type pump having an auxiliary pump capable of minimizing noise being generated by the contact between mechanical components for receiving a driving force from a driving shaft driving a main pump and for driving the auxiliary pump and of reducing a manufacturing cost of the tandem-type pump and the number of manufacturing processes due to minimizing the number of the mechanical components.

In order to achieve the above object, the present invention provides a tandem-type pump having, two main pumps coaxially disposed on a single driving shaft and driven by the driving shaft, the tandem-type pump comprising:

- a first housing supporting the driving shaft and enclosing the main pumps;
- a driving gear installed on the driving shaft under the state that the driving gear is positioned at a position in ahead of the main pumps or a position at the back of the main pumps in the direction of the driving shaft;
- a driven gear being directly engaged with the driving gear;
- an auxiliary pump having an auxiliary shaft, the auxiliary shaft being provided with a driven gear; and
- a second housing enclosing the auxiliary pump.

The first housing and the second housing are integrally formed with each other, the auxiliary pump is supported by two or more sets of bearing means within the second housing.

An outer diameter of a first bearing which is earlier fabricated into the second housing than a second bearing is smaller than that of the second bearing.

Preferably, the first housing and the second housing can be separated from each other.

As described above, the tandem-type pump having the auxiliary pump according to the present invention is not located at the middle of main pumps which are positioned at both sides of a wobble plate-type piston pump. Accordingly, the driving gear and the driven gear are directly engaged with each other. Therefore, the internal structure of the tandem-type pump is simple. In other words, it is possible to remove two or more idle gears and a large number of supporting bearings as employed in the prior art. As a result, the manufacturing cost of the components is reduced and the time spent in fabricating the tandem-type pump is greatly reduced.

BRIEF DESCRIPTION OF THE DRAWINGS

The above object and other characteristics and advantages of the present invention will become more apparent by describing in detail a preferred embodiment thereof with reference to the attached drawings, in which.

DETAILED DESCRIPTION OF THE INVENTION

Hereinafter, a preferred embodiment of the present invention will be explained in more detail with reference to the accompanying drawings.

In the preferred embodiment of the present invention, a driving gear is disposed at a position in ahead of two main pumps. Alternately, it is possible to dispose the driving gear at the back of the main pumps.

Figure 1:
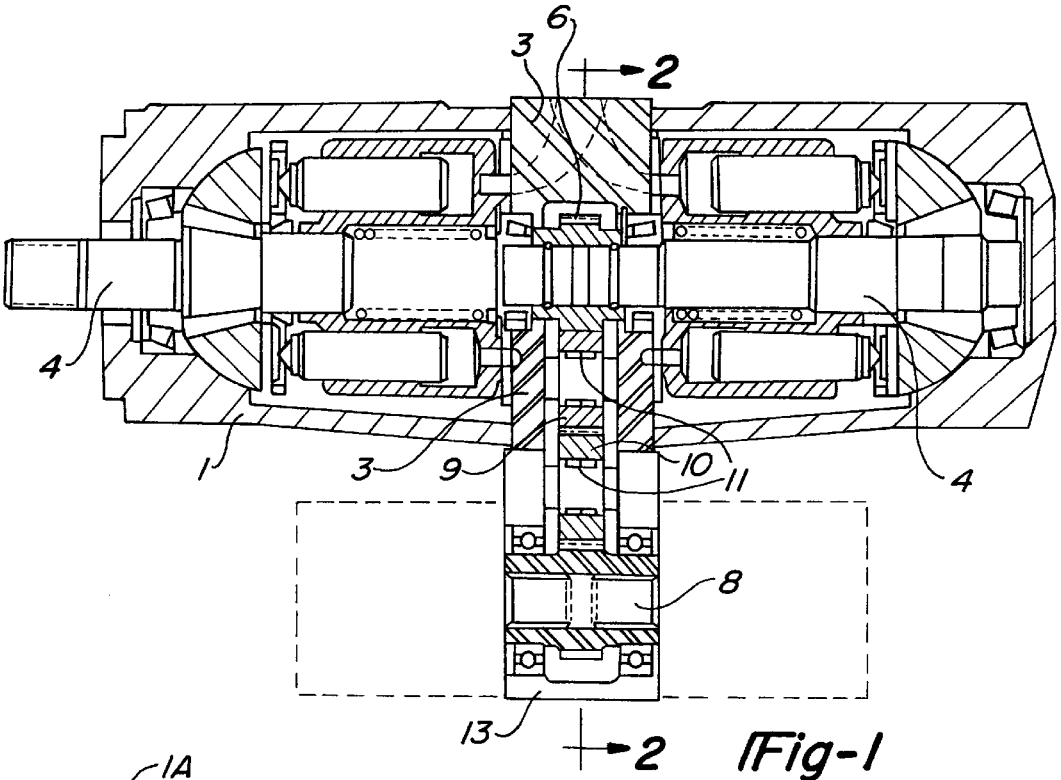
Fig-1 PRIOR ART
FIG. 1 is a schematic sectional view of an auxiliary pump according to the prior art.
Figure 3:
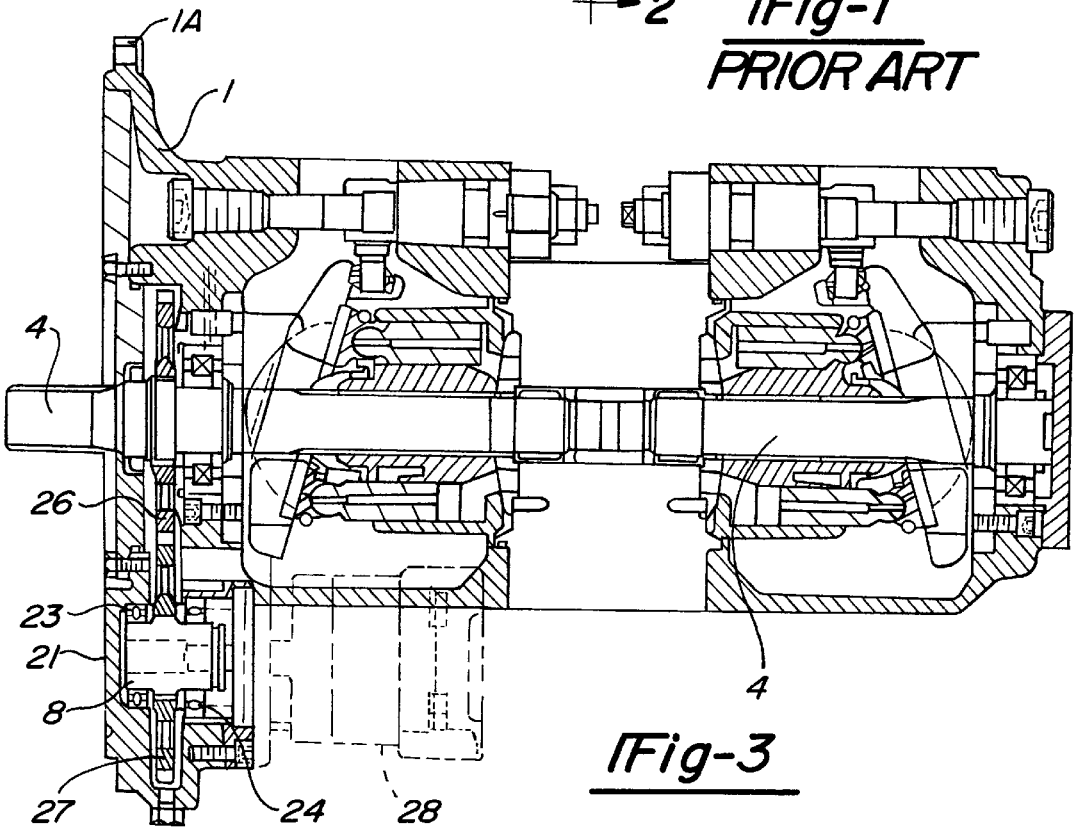
FIG. 3 is a schematic sectional view of an auxiliary pump according to a preferred embodiment of the present invention.
Figure 2:
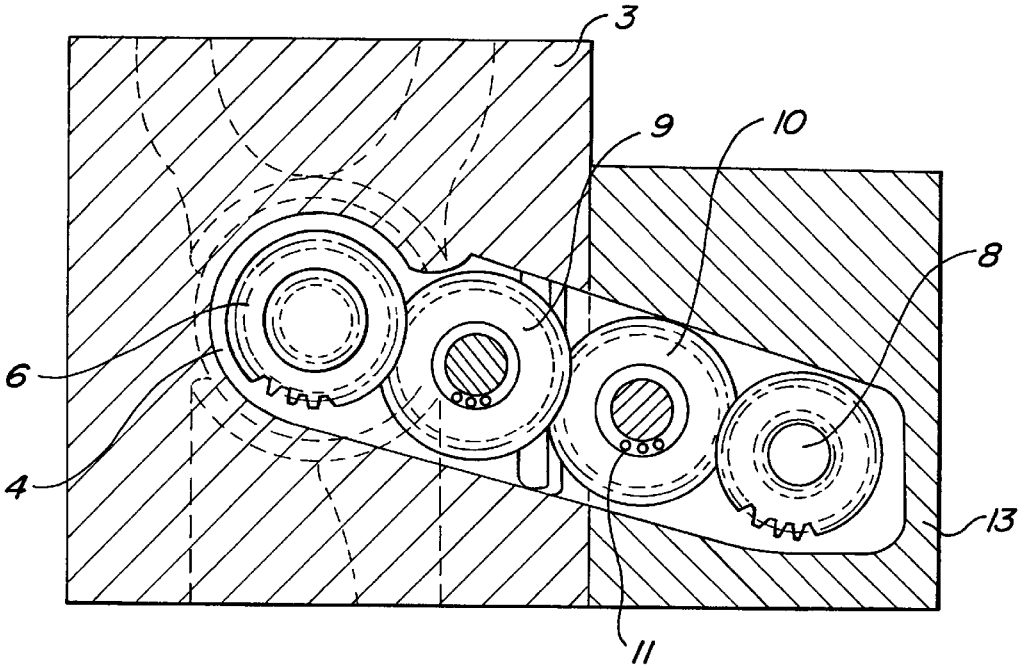
Fig-2 PRIOR ART
FIG. 2 is a sectional view taken along a line A—A of FIG. 1.

FIG. 3 is a schematic sectional view of an auxiliary pump according to a preferred embodiment of the present invention.

Figure 4:
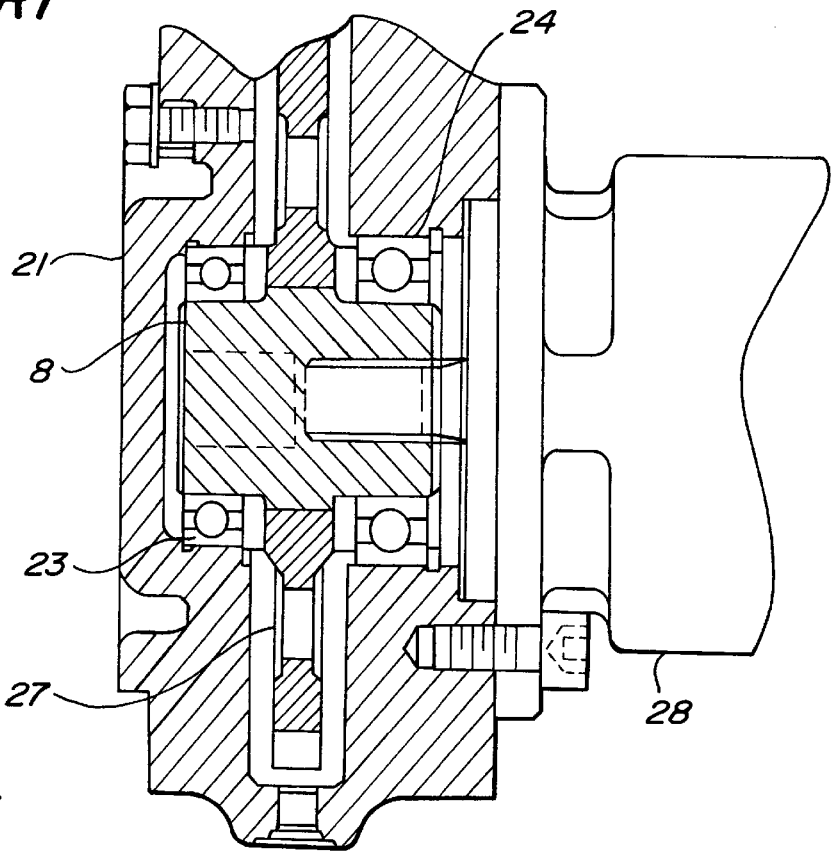
FIG. 4 is an enlarged sectional view of the principal part as shown in FIG. 3.

FIG. 4 is an enlarged sectional view of the principal part as shown in FIG. 3.

Referring to FIGS. 3 and 4, a driving gear 26 is disposed on a driving shaft 4 of main pumps. The driving gear 26 is disposed at a position in ahead of both the main pumps, that is a position adjacent to a mounting flange 1*a* for mounting the main pumps to construction equipment (not shown). A lower portion of the driving gear 26 is engaged with a driven gear 27. The driven gear 27 is installed on an auxiliary shaft 8 for driving an auxiliary pump 28. The auxiliary shaft 8 is supported by two bearings 23, 24 in an extension housing 21 extending from a housing 1 of the main pumps. The extension housing 21 is integrally formed with the housing 1.

As illustrated in FIG. 4, the outer diameter of the first bearing 23 is smaller than that of the second bearing 24 to enable the first bearing 23 to be easily inserted into the extension housing 21. Consequently, it is convenient to fabricate the tandem-type pump. The extension housing 21 can be formed as a separate housing which can be mounted or separated to/from the housing 1 as occasion demands in order to easily repair the auxiliary pump.

If the driving shaft 4 rotates, the main pumps located at both sides of the driving shaft 4 also operate. Further, the driven gear 27, which is engaged with the driving gear 26 installed on the driving shaft, also rotates. As a result, the auxiliary rotates and thereby the auxiliary pump also operates.

If the RPM counts of the driving gear 26 and the driven gear 27 are changed by changing the number of teeth of the driving gear 26 and the driven gear 27, it is possible to obtain a desired output of the auxiliary pump.

The tandem-type pump having the auxiliary pump according to the present invention is not located at the middle of main pumps which are positioned at both sides of the wobble plate-type piston pump. Accordingly, the driving gear and the driven gear are directly engaged with each other. Therefore, the internal structure of the tandem-type pump is simple. In other words, it is possible to remove two and more idle gears and a large number of supporting bearings according to the prior art. As a result, the manufacturing cost of components is reduced and the time spent in fabricating the tandem-type pump is highly reduced.

Further, since the auxiliary shaft for operating the auxiliary pump can be driven without using a large number of stages for transmitting the driving force, the noises being generated during engagement of the gears transmitting the driving force is decreased and the loss of the driving force highly decrease. In addition, since the auxiliary shaft is integrally formed with the housing of the main pump, it is not necessary to install an additional auxiliary pump block. Finally, since the auxiliary pump is installed at a position adjacent to the mounting flange for mounting the main pump to the construction equipment, the inertial moment of the auxiliary pump is decreased. As a result, the vibration being generated during operation of the pump is decreased.

While the present invention has been particularly shown and described with reference to a particular embodiment thereof, it will be understood by those skilled in the art that various changes in form and details may be effected therein without departing from the spirit and scope of the invention as defined by the appended claims.

What is claimed is:

1. A tandem-type pump assembly, comprising:

a first housing having a mounting flange;

a first main pump being disposed in said first housing;

a second main pump being disposed in said first housing, said second main pump being coaxially aligned with said first main pump;

a first driving shaft being rotatably supported in said first housing and coaxially interconnecting said first main pump and second main pump;

a driving gear being fixed to an end of said first driving shaft generally adjacent to said mounting flange for rotation therewith;

a second housing mounted to said first housing;

an auxiliary pump being disposed on said housing;

a second driving shaft being rotatably supported in said second housing, said second driving shaft driving said auxiliary pump; and a driven gear being fixed to said second driving shaft for rotation therewith, said driven gear directly engaging said driving gear.

2. The tandem-type pump assembly according to claim 1 wherein said first housing is integrally formed with said second housing.

3. The tandem-type pump assembly according to claim 1, further comprising:

at least two bearings supporting said auxiliary shaft, said at least two bearings being disposed in said second housing.

4. The tandem-type pump assembly according to claim 3 wherein an outer diameter of one of said at least two bearings is generally smaller than an outer diameter of the other of said at least two bearings to facilitate insertion of said at least two bearings into said second housing.

* * * * *